US008641353B2

(12) United States Patent
Alghamdi

(10) Patent No.: US 8,641,353 B2
(45) Date of Patent: Feb. 4, 2014

(54) SYSTEM FOR STORING AND RETRIEVING SHOES

(75) Inventor: Mohammad Alissan Alghamdi, Riyadh (SA)

(73) Assignee: King Saud University, Riyadh (SA)

( * ) Notice: Subject to any disclaimer, the term of this patent is extended or adjusted under 35 U.S.C. 154(b) by 213 days.

(21) Appl. No.: 13/218,404

(22) Filed: Aug. 25, 2011

(65) Prior Publication Data

US 2013/0051959 A1 Feb. 28, 2013

(51) Int. Cl.
*B65G 1/04* (2006.01)

(52) U.S. Cl.
USPC ..... 414/277; 414/280; 414/286

(58) Field of Classification Search
USPC ..... 414/277, 286, 280, 741
See application file for complete search history.

(56) References Cited

U.S. PATENT DOCUMENTS

| | | | | | |
|---|---|---|---|---|---|
| 860,149 | A | * | 7/1907 | Platt | 414/286 |
| 940,878 | A | * | 11/1909 | Jones et al. | 414/663 |
| 2,451,120 | A | | 10/1948 | Rosseter | |
| 3,504,808 | A | * | 4/1970 | Carabateas | 414/283 |
| 3,782,565 | A | * | 1/1974 | Doran et al. | 414/274 |
| 4,191,435 | A | | 3/1980 | Lehman | |
| 4,422,554 | A | | 12/1983 | Lichti | |
| 4,690,602 | A | * | 9/1987 | Castaldi et al. | 414/282 |
| 4,756,657 | A | * | 7/1988 | Kinney | 414/281 |
| 4,856,956 | A | * | 8/1989 | Zur | 414/280 |
| 4,858,743 | A | * | 8/1989 | Paraskevakos et al. | 194/205 |
| 4,958,976 | A | * | 9/1990 | Haueter | 414/331.01 |
| 4,975,012 | A | * | 12/1990 | Motoda | 414/279 |
| 5,104,277 | A | * | 4/1992 | Bullock | 414/280 |
| 5,139,384 | A | * | 8/1992 | Tuttobene | 414/281 |
| 5,369,892 | A | | 12/1994 | Dhaemers | |
| 5,833,427 | A | * | 11/1998 | Siegler et al. | 414/277 |
| 5,863,172 | A | | 1/1999 | Pearson | |
| 5,984,113 | A | | 11/1999 | Roberson | |
| 6,086,171 | A | | 7/2000 | Ashley et al. | |
| 6,119,880 | A | | 9/2000 | Dueck | |
| 6,416,270 | B1 | * | 7/2002 | Steury et al. | 414/282 |
| 6,499,935 | B1 | * | 12/2002 | Hirakawa et al. | 414/741 |
| 6,598,948 | B1 | | 7/2003 | Harmon | |
| 6,811,108 | B2 | * | 11/2004 | Iino | 414/741 |
| 6,854,815 | B1 | | 2/2005 | Smith | |

(Continued)

FOREIGN PATENT DOCUMENTS

| | | | | | |
|---|---|---|---|---|---|
| CN | 201388731 | | | 1/2010 | |
| DE | 3305277 | A1 | * | 8/1984 | 414/277 |
| JP | 21-56904 | | | 6/1990 | |
| WO | WO 93/25458 | A1 | * | 12/1993 | 414/280 |

*Primary Examiner* — James Keenan
(74) *Attorney, Agent, or Firm* — Richard C. Litman

(57) ABSTRACT

The system for storing and retrieving shoes includes a cabinet defining a housing enclosing storage units. The housing defines a central shaft for raising and lowering shoe trays, and defines two columns of storage rack units for the shoe trays on opposite sides of the central shaft. A portal at the base of the central shaft provides access for placing shoes on a shoe tray and retrieving the shoes from the cabinet. A long support arm is movable horizontally to align a shoe tray in either the left or the right column of rack units. A short support arm is movable vertically on the long arm to align the shoe tray vertically, and has clips for grasping and releasing the shoe trays. An electronic control system controls movement of the two arms, and issues a card or claim check identifying the storage rack unit for later retrieval of the shoes.

7 Claims, 12 Drawing Sheets

(56) References Cited

U.S. PATENT DOCUMENTS

| | | | | |
|---|---|---|---|---|
| 7,168,905 | B1 * | 1/2007 | Solomon et al. | 414/237 |
| 7,212,885 | B2 | 5/2007 | Diaz et al | |
| 7,771,152 | B2 * | 8/2010 | Waltersbacher | 414/280 |
| 7,850,411 | B2 * | 12/2010 | Solomon | 414/277 |
| 8,303,233 | B2 * | 11/2012 | Solomon | 414/277 |
| 8,417,373 | B2 * | 4/2013 | Clo' | 700/218 |
| 2006/0045674 | A1 * | 3/2006 | Craven | 414/277 |
| 2007/0295580 | A1 | 12/2007 | Solomon | |

* cited by examiner

SYSTEM FOR STORING AND RETRIEVING SHOES

BACKGROUND OF THE INVENTION

1. Field of the Invention

The present invention relates to shoe storage, and more particularly to a system for storing and retrieving shoes that allows users of the system to store and later reclaim their shoes by presenting a unique identifier.

2. Description of the Related Art

Muslims have utilized new building techniques and introduced many of the advances of modern technology to make mosques more convenient and comfortable. Some examples include the introduction of modern sound systems, the use of air conditioning, and special clocks that calculate and indicate daily prayer times, which change according to the path of the sun at different times of the year.

One area that has not received attention is the Muslim practice of removing one's shoes when the worshiper enters at the front of the mosque (it is forbidden to wear shoes on the prayer carpet, and this practice is often extended to other areas of the mosque). In many mosques, shoes are left on the floor in disorganized fashion, often presenting an inconvenience or obstruction for worshipers entering and leaving the mosque, sometimes presenting a safety hazard when an emergency requires quick entry or exit, and having the potential for loss of the shoes by mistake or theft. This problem is common at ordinary mosques, but is exacerbated at mosques in some of the larger cities, which have the capacity for thousands of worshipers, and at the holy cities in Makkah (Mecca) and Maddenah (Medina) in Saudi Arabia, which have capacities approaching or exceeding one million people.

In addition to mosques, there are other places and situations where a group of people may be required to remove their shoes before using a public or private space, including places of worship, restaurants, houses, palaces, and certain commercial establishments, e.g., bowling alleys, ice skating or roller skating rinks, etc.

Thus, a system for storing and retrieving shoes solving the aforementioned problems is desired.

SUMMARY OF THE INVENTION

The system for storing and retrieving shoes includes a cabinet defining a housing enclosing storage units. The housing defines a central shaft for raising and lowering shoe trays, and defines two columns of storage rack units for the shoe trays on opposite sides of the central shaft. A portal at the base of the central shaft provides access for placing shoes on a shoe tray and retrieving the shoes from the cabinet. A long support arm is movable horizontally to align a shoe tray in either the left or the right column of rack units. A short support arm is movable vertically on the long arm to align the shoe tray vertically, and has clips for grasping and releasing the shoe trays. An electronic control system controls movement of the two arms, and issues a card or claim check identifying the storage rack unit for later retrieval of the shoes.

A plurality of cabinets may be arranged in a linear row, a circular array, back-to-back, or any other desired arrangement in the vestibule or storage room of a building for storing shoes for a large group of people.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
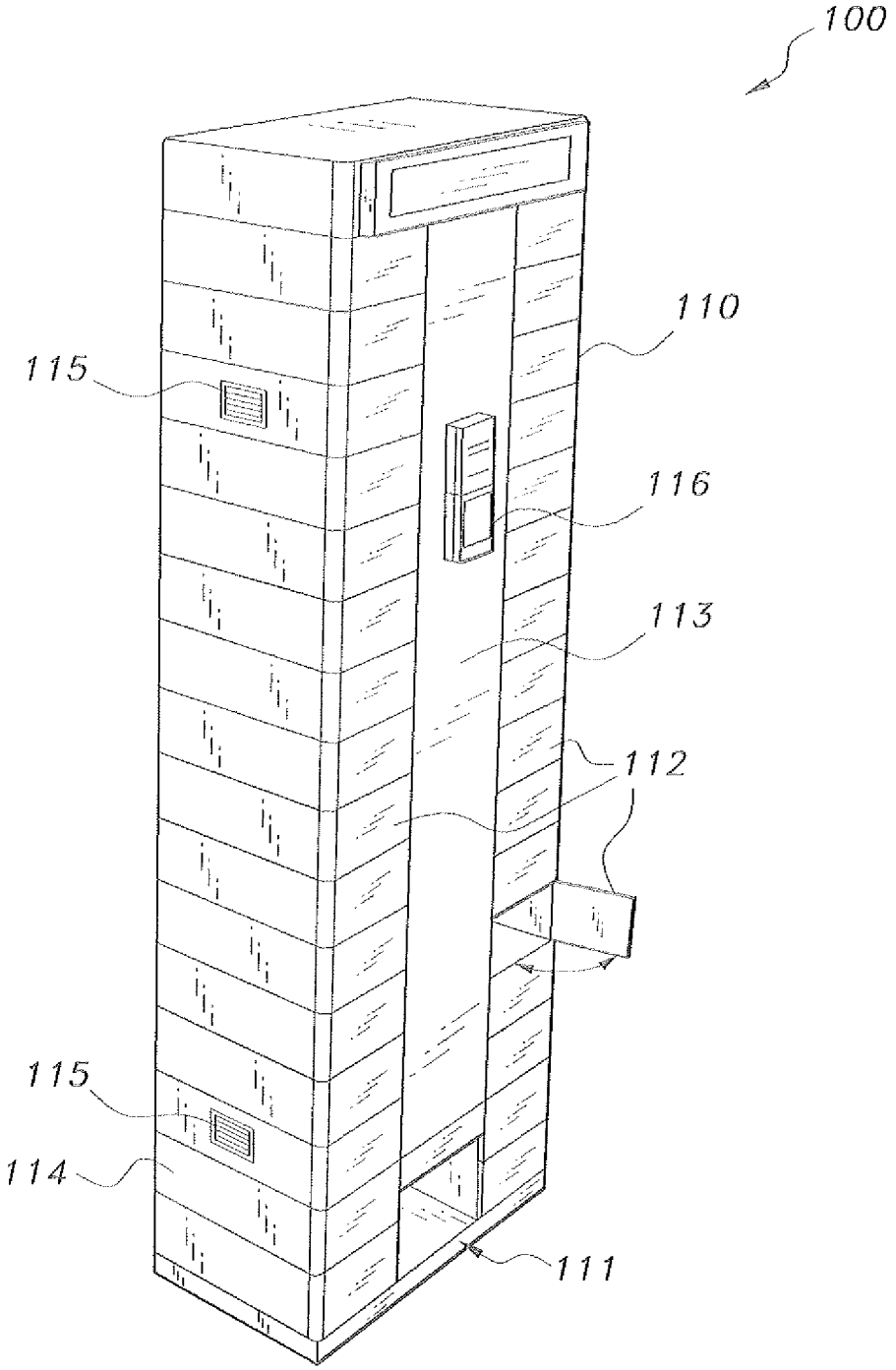
FIG. 1 is a perspective view of a system for storing and retrieving shoes according to the present invention, showing an external view of the housing.

As shown in FIG. 1, the system for storing and retrieving shoes, designated generally as 100 in the drawings, has a housing 110 defining a portal 111. Shoes may be inserted into portal 111 for storage and later retrieved by the shoes' owner through the same portal 111. The portal 111 may be covered by a door to keep dust out and to help maintain any climate control used with the system 100. A door for the portal 111 may swing to either side, swing up, swing down, or slide in a horizontal or vertical direction.

There may also be one or more access doors 112 on the front 113 of housing 110 to provide access to the interior of the housing 110. The access doors 112 may be used as an alternative to the portal 111 for retrieving shoes in the event of malfunction of the system 100 or a power failure. The access doors 112 may also provide access to the interior of the housing 110 for maintenance and cleaning.

The access doors 112 may swing or slide open, and may be a single panel, or may include both the front and one side 114 of housing 110. Alternatively, the access doors 112 may be hinged so that an entire side, including at least a portion of three sides of the housing, 110 pivots away from a central portion of the housing 110.

The housing 110 may also include vents 115. The vents 115 may provide cross-flow ventilation to the interior of the housing 110. The ventilation may be natural or forced.

An electronic control unit 116 may be mounted on an exterior wall of the housing 110. The control unit 116 may include an input device and/or an output device.

The input device may be a bar code scanner, a magnetic card reader, a radio frequency identification ("RFID") device reader, or any other reader for reading information from a claim cheek or token in any suitable physical form. Alternatively, a keypad or touch screen may be used. Smart phones or similar wireless electronic devices may also be used to input identification information to the input device.

The output device may be capable of printing out bar codes, a paper claim check having an alphanumeric code that may be input to a keypad or touch screen, cards with magnetic strips, or any other physical card, token, or receipt. The output device of the control unit 116 may optionally be configured to transmit identification information to a smart phone, RFID device, or similar wireless device to be saved and used later to recover a user's shoes.

Figure 2:
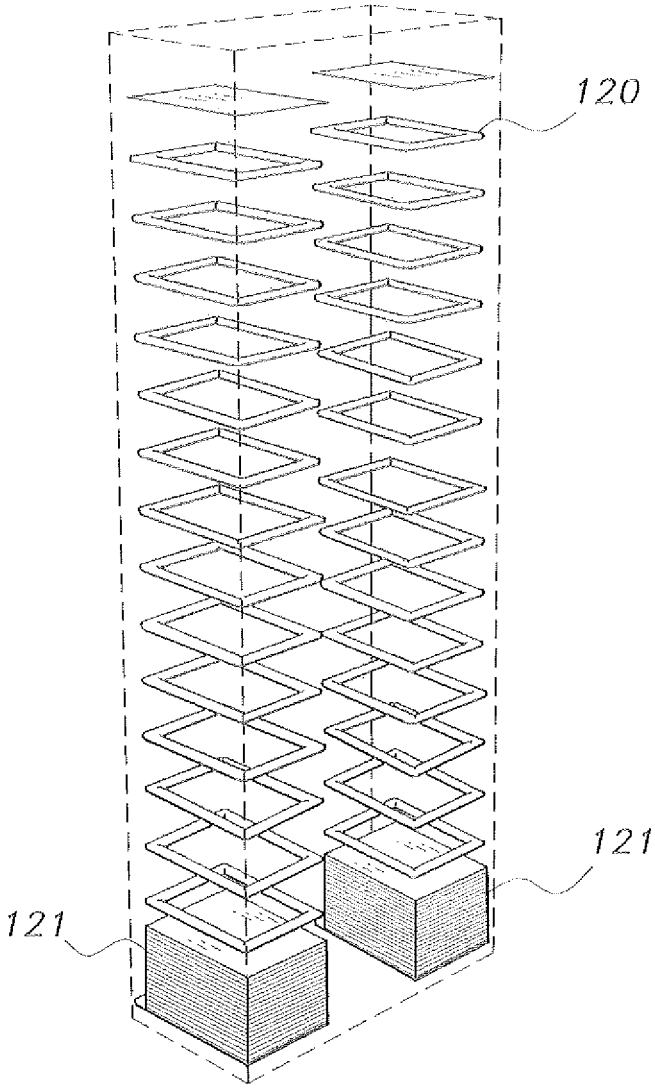
FIG. 2 is a diagrammatic perspective view of the interior of the housing of FIG. 1, showing an arrangement of storage rack units on opposite sides of the central shaft.

FIG. 2 shows an arrangement of internal storage rack units 120 within the housing 110. The storage rack units 120 may be simple frames made of rails and cross-members, as shown, or they may be solid flat sheets on which shoe trays 121 may rest. The storage rack units 120 may also be solid sheets having a depressed area in the center in which shoe trays 121 may rest. The storage rack units 120 may be supported from the internal walls of the housing 110 or may be supported from a base of the housing 110.

As shown in FIG. 2, the cabinet or housing 110 defines three columns, including a central shaft and two columns of storage rack units 120 on opposite sides of the central shaft. The portal 111 of FIG. 1 is defined at the base of the central shaft, the shaft providing an empty column for raising and lowering shoe trays vertically to and from the corresponding level of a desired individual storage rack unit 120.

Empty shoe trays 121 may be stored underneath the columns of storage rack units 120 until they are needed to hold shoes being placed into the portal 111. An empty shoe tray 121 may be placed inside the housing 110 behind the portal 111 to await placement of shoes for storage.

Figure 3:
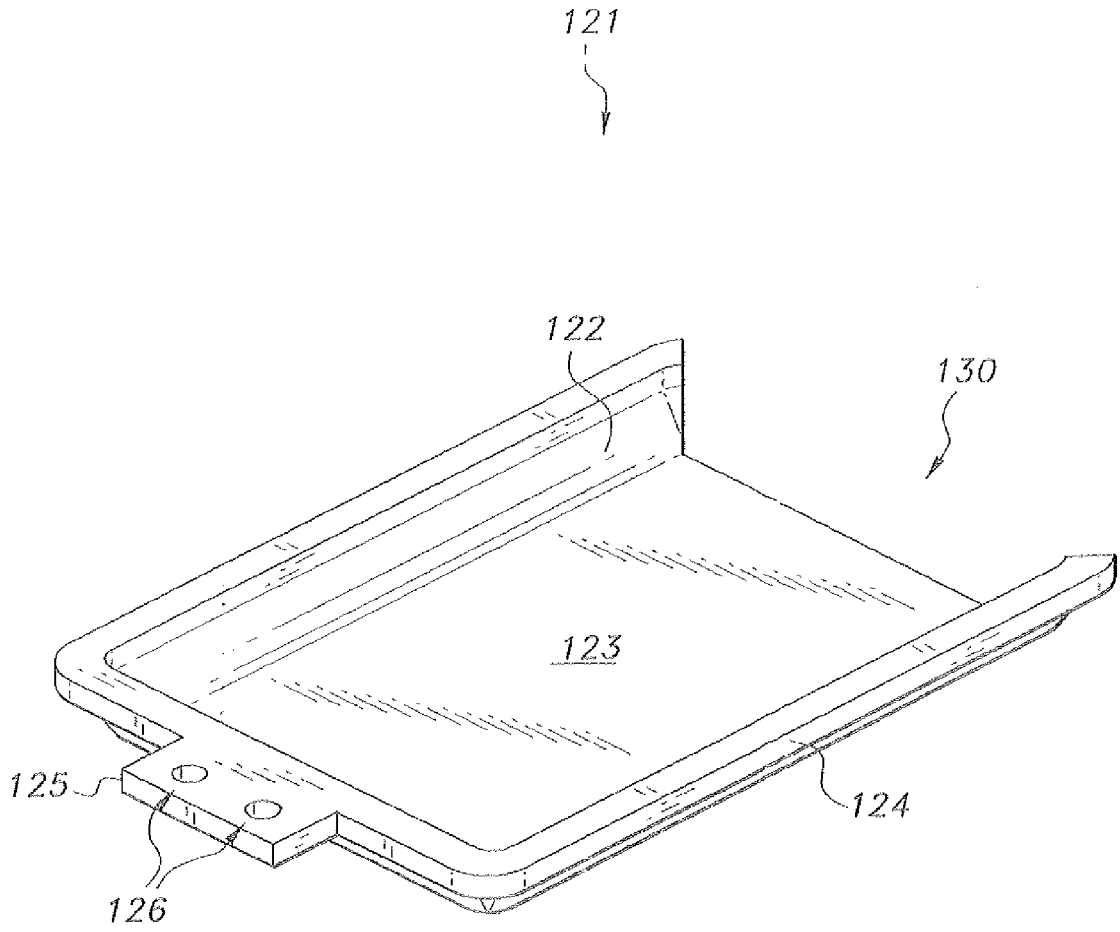
FIG. 3 is a perspective view of an exemplary shoe tray for use in the system of FIG. 1.

An embodiment of a shoe tray 121 is shown in FIG. 3. The shoe tray 121 may be sized large enough to store most shoes and may have at least one wall 122 surrounding a base 123 to keep shoes from sliding off the tray 121. There may be a lip 124 attached to the tops of walls 122 to allow shoe trays 121 to rest on the frame of the storage rack units 120. As shown in FIG. 3, preferably one end 130 of shoe tray 121 is open, providing access to the shoes stored therein.

There may be a flange 125 extending from the lip 124 at one end of the shoe tray 121. The flange 125 may facilitate movement of the shoe trays 121 by providing a place to pick up the trays 121. Holes 126 may help secure shoe trays 121 as they are being picked up, as will be explained below. As shown, flange 125 is preferably positioned opposite the open end 130 of the shoe tray 121.

The shoe tray 121 may be fabricated from a wide variety of materials, including, but not limited to, polymers, metal, and wood. Shoe trays 121 may be dimensioned so that, when shoe trays 121 are together, open space exists between the flanges 125 of adjacent shoe trays 121 to facilitate grasping the flanges 125.

Figure 4:
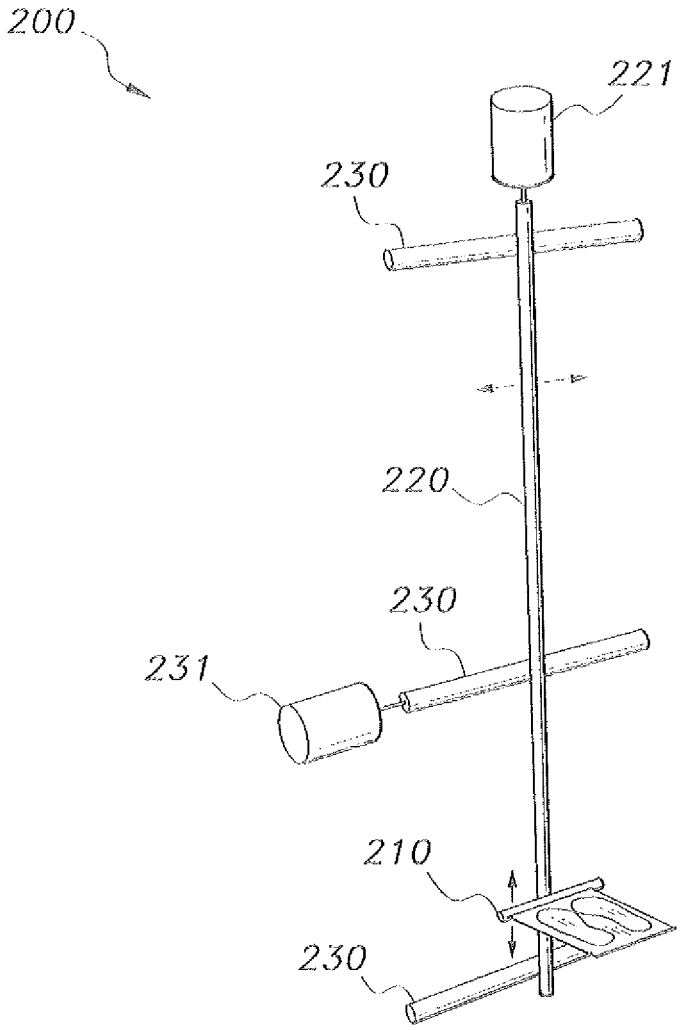
FIG. 4 is a diagrammatic perspective view of an exemplary mechanism for moving shoe tray of FIG. 3 for alignment with the storage rack units of FIG. 2.

FIG. 4 shows an embodiment of a mechanism 200 for moving the shoe trays 121. The mechanism 200 may have a short arm 210 for grasping shoe trays 121, the short arm 210 having a width about equal to the width of the central shaft or either one of the columns of storage rack units 120. The short arm 210 may traverse a portion of the length of the long vertical arm 220, and the vertical arm 220 may traverse a portion of the length of one or more horizontal frame arms 230 to align the shoe trays 121 horizontally and vertically with a desired storage rack unit 120 to store the shoes.

A variety of means may be used to move the short arm 210 and an attached shoe tray 121 between the portal 111 and a desired storage rack unit 120. The means may include, but not be limited to, one or more of belt and sheave systems, pulleys and cables, racks and pinions, screw drive systems, worm gears, or any other means known to those in the art to be suitable for the purpose. The exemplary mechanism 200 will be described using screw drives as a motive force for moving short arm 210 in a vertical direction and vertical arm 220 along horizontal arm(s) 230.

Figure 5:
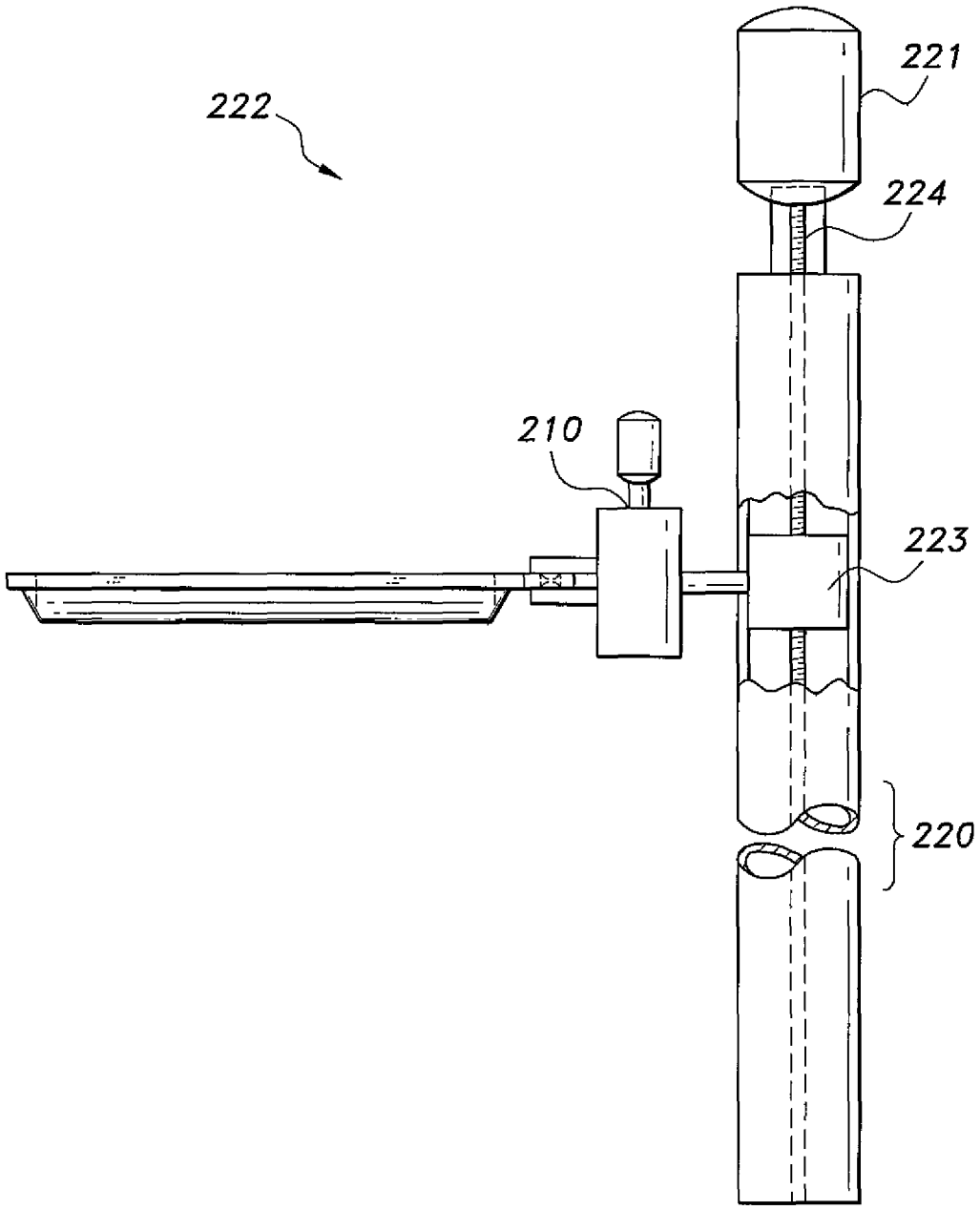
FIG. 5 is a side view of an exemplary drive system for moving the shoe tray of FIG. 3 in a vertical direction.

Short arm 210 may be moved along the length of vertical arm 220 by a vertical screw drive 222 driven by vertical drive motor 221, as shown in FIG. 5. Although vertical arm 220 is shown as a hollow channel in which vertical driven element 223 (shown in the broken portions of the vertical arm 220) having internal threads is moved by rotating threaded rod 224, driven element 223 may travel along vertical arm 220 shaped like a rail. Vertical driven element 223 may ride along a rail-shaped vertical arm 220 on wheels (not shown) or may be shaped to ride along a rail-shaped vertical arm 220 without wheels.

Figure 6:
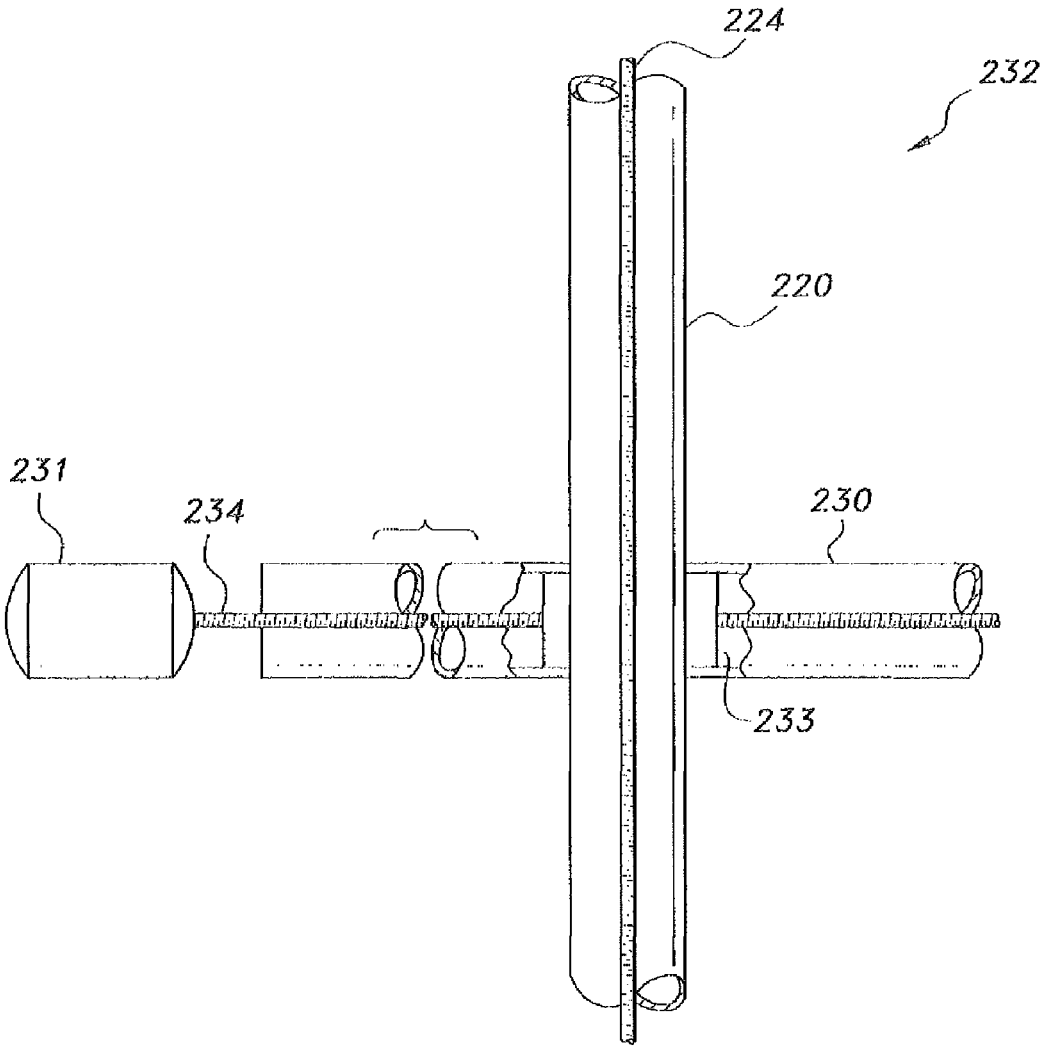
FIG. 6 is a side view of an exemplary drive system for moving the shoe tray of FIG. 3 in a horizontal direction.

Similar in operation to vertical screw drive 222, horizontal screw drive 232 is shown in FIG. 6. Horizontal drive motor 233 may be mounted on a horizontal arm 230. Vertical arm 220 may be moved along the length of horizontal rod(s) 230 by horizontal screw drive 232 driven by horizon drive motor 231. Vertical rod 220 may be attached to internally threaded horizontal driven element 233. As shown, horizontal driven element 233 may travel inside horizontal arm 230.

One or more additional horizontal arms 230 may be used to assist in guiding vertical arm 220 in the horizontal direction, but may or may not include drives. Wheels (not shown) may be mounted on vertical arm 220 to ride one or more rail-shaped horizontal arms 230. Other means of guiding vertical arm 220 may be used. Those means will be understood by those skilled in the art. Horizontal arms 230 may be mounted to a wall or a floor of housing 110.

Figure 7:
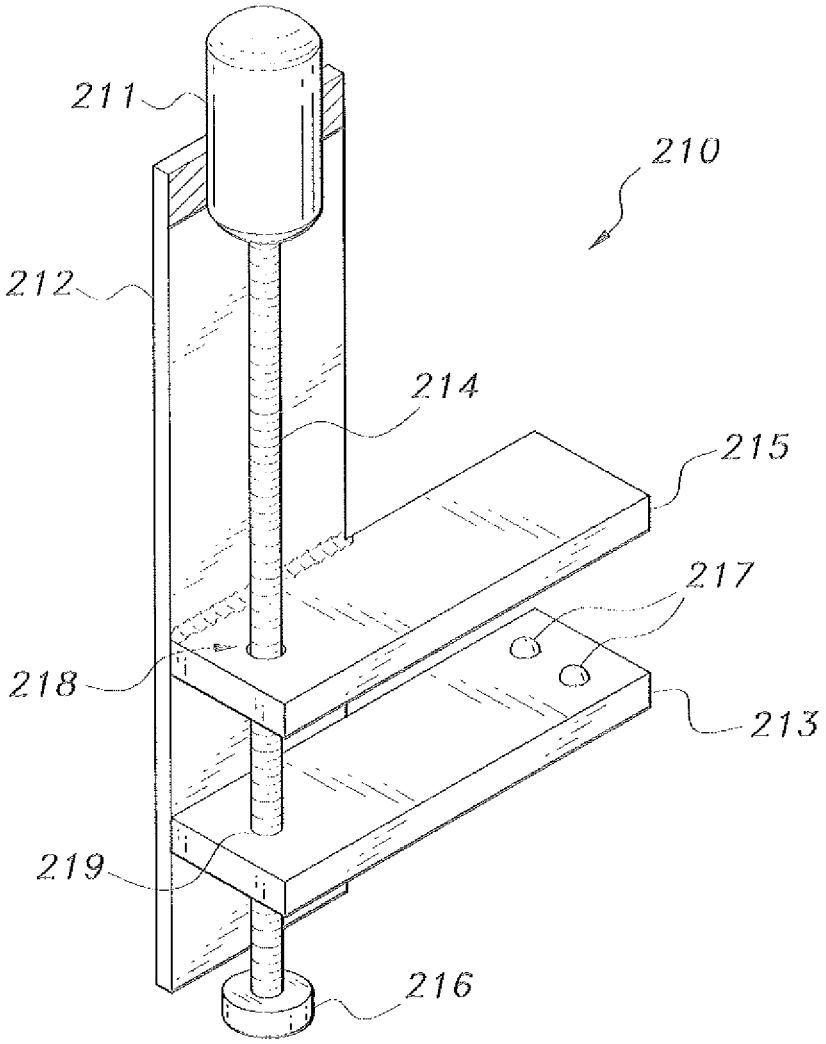
FIG. 7 is a perspective view of an exemplary arm for holding shoe tray of FIG. 3.
Figure 8:
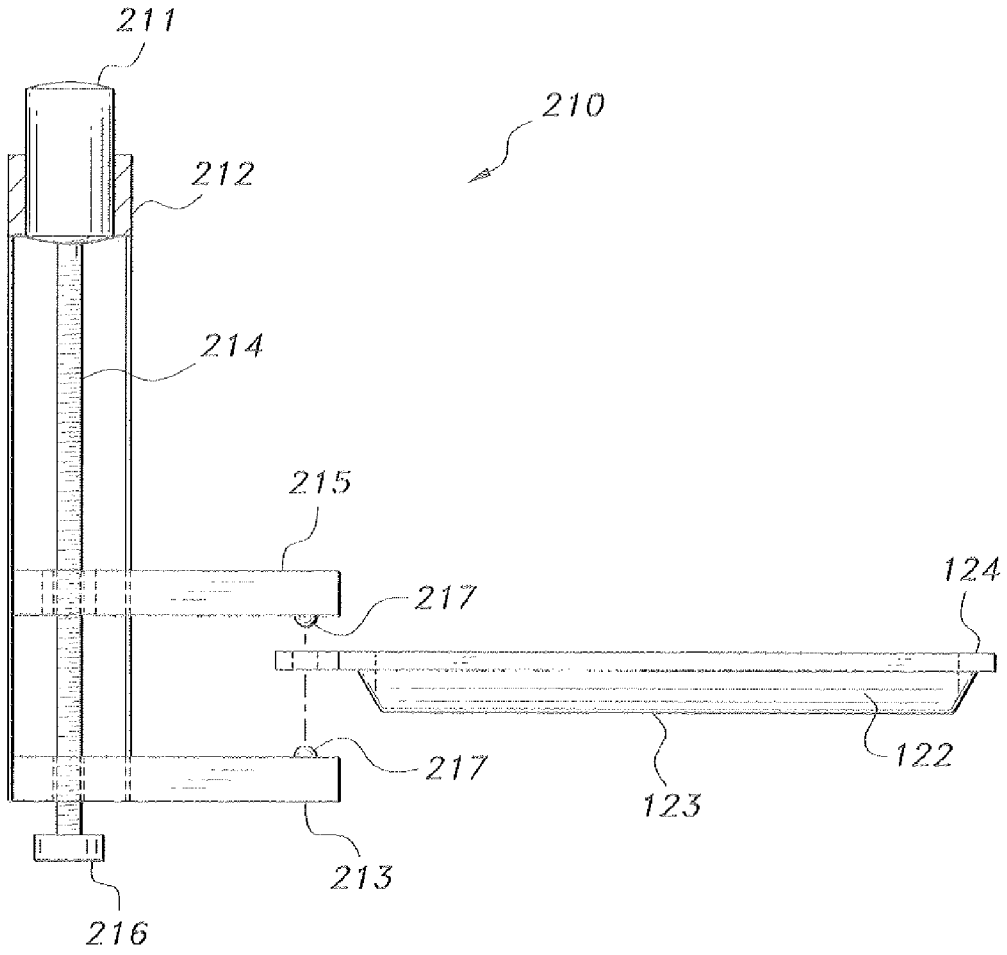
FIG. 8 is a side view of the arm of FIG. 7 before grasping the shoe tray of FIG. 3.
Figure 9:
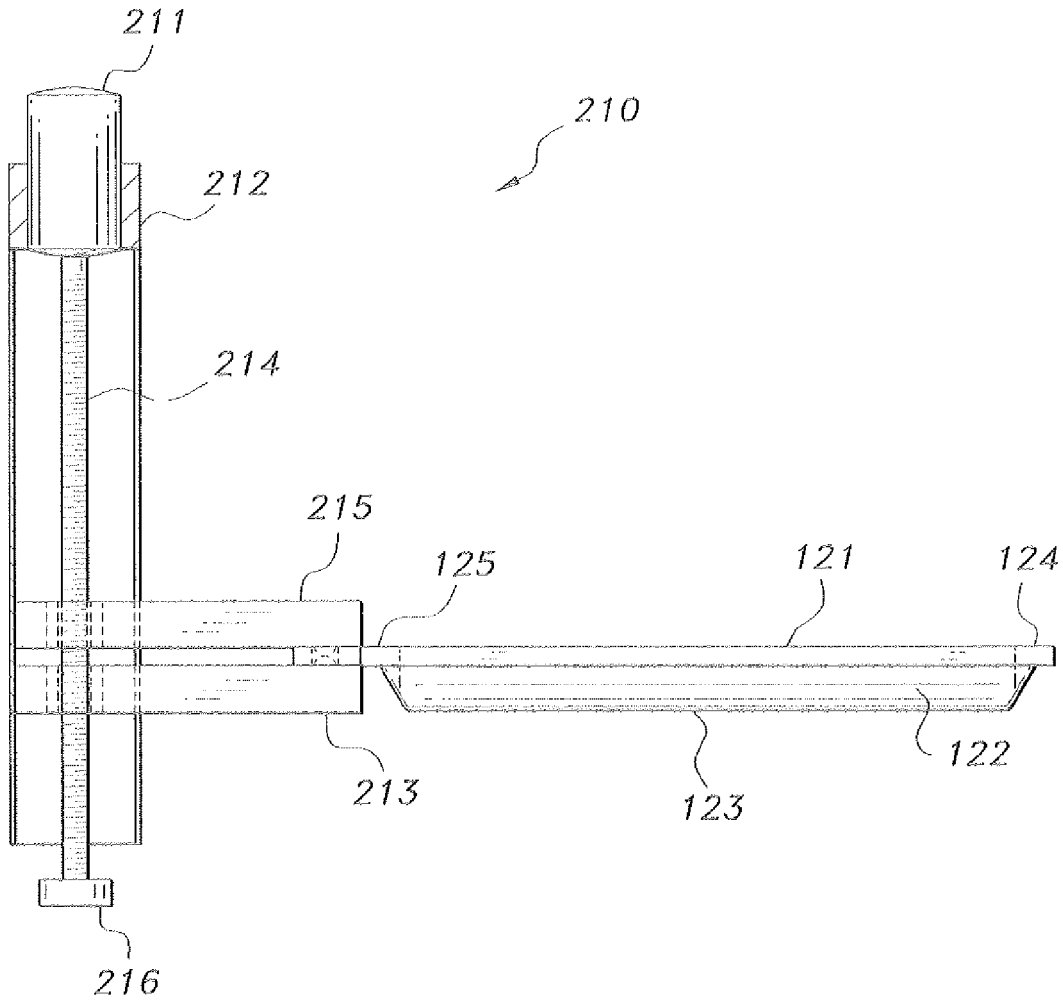
FIG. 9 is a side view of the arm of FIG. 7 grasping a shoe tray of FIG. 3.

An embodiment of short arm 210 using a threaded drive is shown in FIGS. 7-9. Other means of grasping the shoe trays 121 may be used including, but not limited to, clips using a solenoid, systems in which jaws move horizontally rather than vertically, electromagnetic systems used with shoe trays at least partially fabricated from ferrous metals, and other means known in the art.

Short arm drive motor 211 and stationary short arm jaw 215 may be mounted on short arm drive mount 212. While short arm drive mount 212 may be a flat plate as shown in FIG. 7, it may also comprise plates on either side of stationary short arm jaw 215 and driven short arm jaw 213, or a three sided enclosure for jaws 213 and 215.

A rotating threaded rod 214 may be rotated by short arm drive motor 211. Rotating threaded rod 214 may pass through non-threaded hole 218 in stationary short arm 215 and threaded hole 219 in driven short arm jaw 213. Rotation of threaded rod 214 in threaded hole 219 may move driven short arm jaw 213 with respect to stationary short arm jaw 215, with the direction of movement dependent on the direction of rotation of threaded rod 214. Stop 216 on threaded rod 214 may prevent driven short arm jaw 213 from moving too far down threaded rod 214 and falling off.

Raised beads 217 on jaws 213 and 215 may engage holes 126 in flanges 125 when jaws 213 and 215 close on flange 125 of a shoe tray 121.

While the above description has stationary horizontal arm 230 and moving vertical arm 220, it is understood that an alternative would be to have a stationary vertical arm and a moving horizontal arm.

Figure 10:
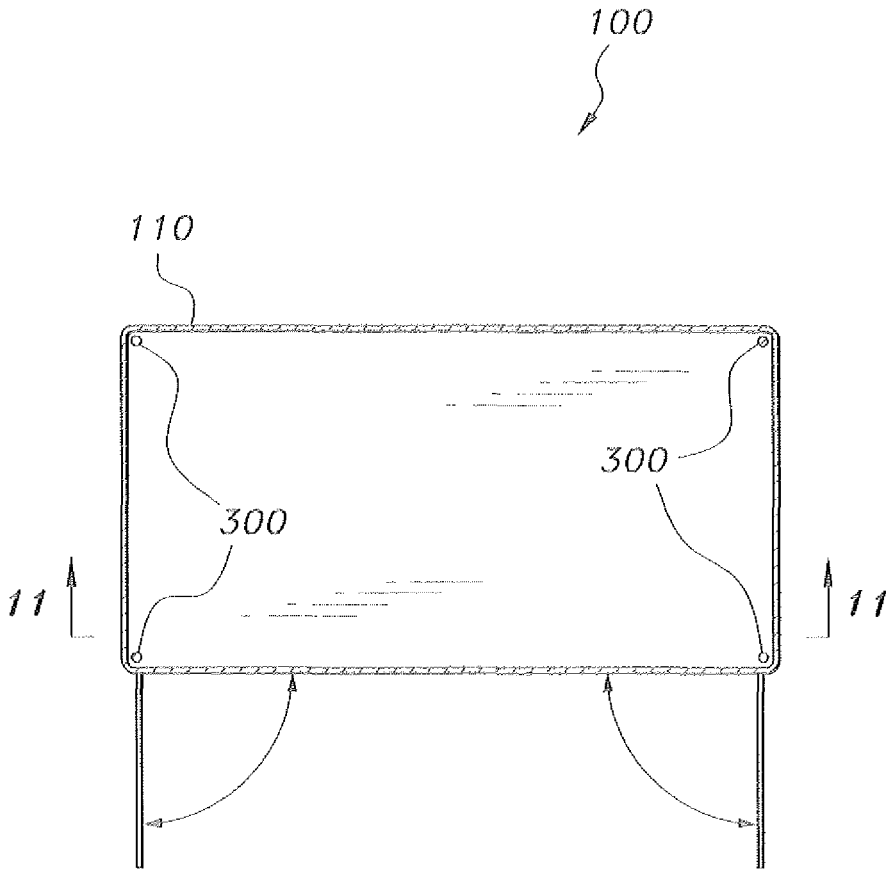
FIG. 10 is a plan view of the housing of FIG. 1, showing ultraviolet lamps.
Figure 11:
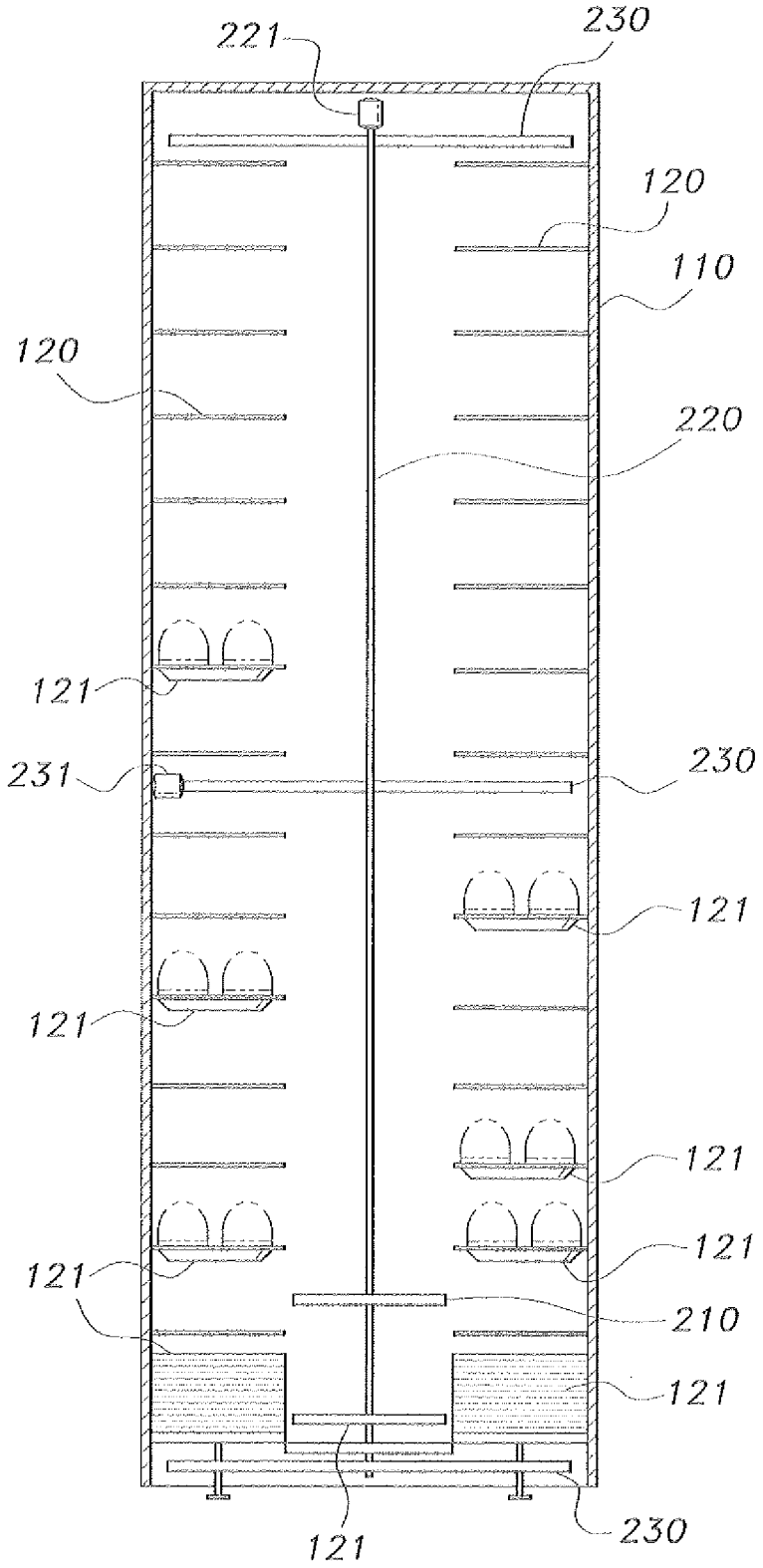
FIG. 11 is a section view along lines 11-11 of FIG. 10.
Figure 12:
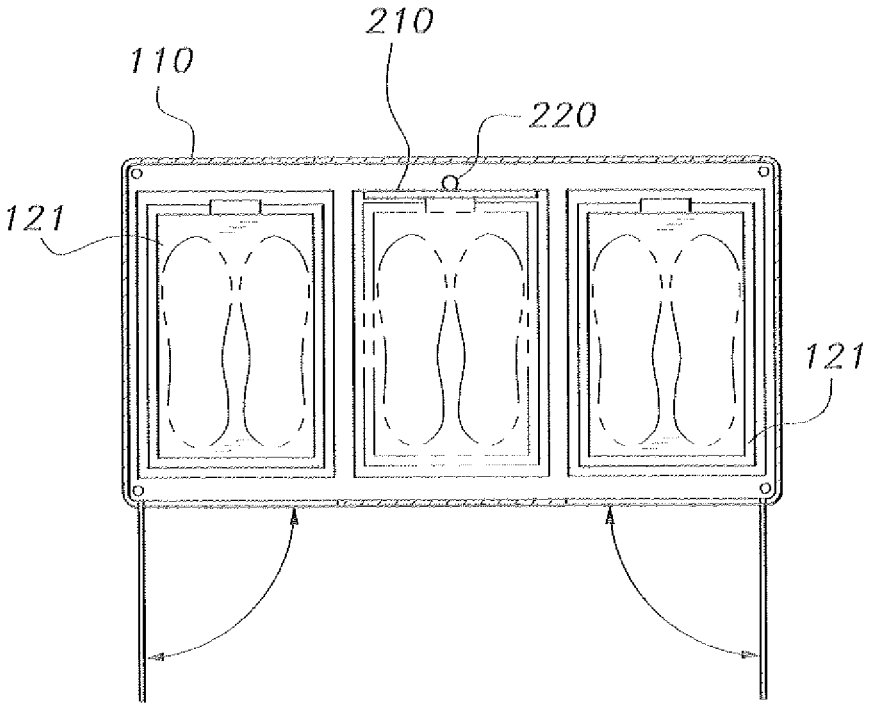
FIG. 12 is a plan view in section of the housing of FIG. 1.

As shown in the plan view of store and dispensing device 100 in FIG. 10, the interior of the hosing 110 may include one or more ultraviolet lamps 300, which may be used to disinfect shoes stored in the system 100 and to purify air in the housing 110. While shown in the corners of the housing 110, the lamps 300 may be in any location that permits good exposure of shoes to ultraviolet light, while also being accessible for replacement.

A climate control unit may also be provided with the system 100. The climate control unit may be used to control temperature and/or humidity within the housing 110.

Operation of shoe storage and dispensing device 100 may be explained using FIGS. 1-12. A user wishing to store his shoes may insert them into shoe storage and dispensing device 100 through the portal 111 and placing the shoes on a shoe tray 121. The user inserting his shoes may then indicate that his shoes are in place to be stored. This indication may be, e.g., pushing a button on the control unit 116. Those skilled in the art will understand the alternatives for indicating that shoes are ready for storage.

If the short arm 710 is not already attached to the shoe tray 121 and jaw 213 is not in lowered position, the short arm 210 may move into position and the short arm drive motor 211 may rotate to lower the jaw 213 into position to grasp the shoe tray 121 on which the shoes rest. The short arm drive motor 211 may then rotate in the opposite direction so that the lower jaw 213 may rise to grasp the shoe tray 171.

The short arm 213 with the attached shoe tray 121 may then be raised to the level of an unoccupied storage rack unit 120 by the rotation of the threaded rod 224 by the vertical drive motor 221. An assembly of the vertical arm 220, the short arm 210, and the shoe tray 121 may then be moved right or left (depending on the location of the empty shelf) by the rotation of threaded rod 234, as directed by the electronic control unit 116.

When the shoe tray 121 is above an empty storage rack unit 120, the jaw 213 may lower and disengage the shoe tray 171. The short arm 210 may remain in place or return to a neutral location.

When a user returns for his shoes, be may provide to the input device of the control unit 116 identification information associated with his shoes, e.g., by running a card or token through a reader or by keypad entry of the storage rack unit location. Similar to the procedure described above with respect to storing shoes, the short arm 210 may return to the location of the stored shoes and grasp the associated shoe tray 171. The short arm 210 may then return the retrieved shoes and associated shoe tray 121 to a location where the user can reclaim his shoes through the portal 111.

If an empty shoe tray 121 is present at the portal 111 when a user is retrieving his stored shoes, the short arm 210 may remove the empty tray before retrieving shoes and return it to storage under a column of storage rack units 120. An empty shoe tray 121 may normally be present at the portal 111. However, it may be desirable to remove empty shoe trays 121 from the area when retrieving shoes to avoid a build-up of empty shoe trays 121 that may impede use of the system 100.

Those skilled in the art will understand that there are a variety of methods that may be used to control the storage and retrieval of shoes. The location of the short arm 210 may be determined by keeping track of revolutions of rotating threaded rods 224 and 234. Other means of determining the location of short arm 210 may include using sonic or optical means to determine distances from reference points or electronic sensors. Other means of determining the location of short arm 210 will be known to those skilled in the art.

The system 100 may use a programmable logic controller ("PLC") (or a computer, microcontroller, or other electronic control system) to keep track of the locations of shoes and of unoccupied storage rack units 120. As shoes are stored, a database may store information concerning the locations of particular shoes among the storage rack units 120. The database may also keep track of unoccupied storage rack units 120.

Alternatively, each storage rack unit 120 may have its own identifier, such as a bar code. One or more bar code readers mounted on the short arm 210 may locate bar codes associated with storage rack units 120 when storing and retrieving shoes.

Rather than being stored in a PLC, locations of stored shoes may be printed on a receipt to be read later by the input device when a user returns to retrieve his shoes.

As an alternative to storing the locations of empty shelves in a PLC, mechanical and electromechanical means may be used to determine unoccupied storage rack units 120. E.g., a switch may be installed at each storage rack unit 120. The position of the switch may be changed whenever a shoe tray 121 is placed on, or removed from, a storage rack unit 120.

Mechanical methods of determining whether a storage rack unit 120 is occupied may include such devices as status bar codes that are changed mechanically by the presence or absence of a shoe tray 121.

Other means of determining locations of stored shoes and empty shelves will be known to those of skill in the art.

It will be recognized that the system 100 may be implemented in many different forms. Movement of the long vertical arm 220 may be supported and guided by fixed grooves in the frame members 230 that receive rollers, flanges, pins, or other members projecting from the vertical arm 220. Horizontal motion of the vertical arm 220 may be controlled by a servo motor housed at the top part of the cabinet or housing 110, and mediated by gear trains, electromagnetic drives, linear actuators, pulleys, solenoids, or other mechanisms. Similarly, the short arm 210 may have rollers, flanges, pins, or other projecting members that are supported and guided by a groove defined in the vertical arm 220, which may be controlled by a motor or other control or drive mechanism mounted on the short arm.

Devices permitting the short arm 210 to grip or clamp the shoe trays 121 include spring-biased clips controlled by a solenoid that hook or clamp to the edge of the tray when the user presses the button on the control unit 116 to signal that the shoes are ready for storage, and release when the tray 121 is aligned with an empty storage rack unit 120, and reverse the operation for retrieval of the shoes. Alternatively, two or more extendable and retractable forks may be attached to the short arm 210, the forks selectively engaging holes in a sidewall of the tray 121. A third mechanism may be electromagnetic attachment of the tray 120 to the short arm 210. The methods and mechanisms described herein are exemplary, and not intended to be limiting.

It is to be understood that the present invention is not limited to the embodiments described above, but encompasses any and all embodiments within the scope of the following claims.

I claim:

1. A system for storing and retrieving shoes, comprising:

an enclosed housing having a central shaft extending vertically therein, the housing having a portal defined at a base of the central shaft;

first and second columns of storage rack units, the first and second columns being disposed within the housing on opposite sides of the central shaft;

a plurality of trays adapted for receiving shoes, wherein each said tray has a flange projecting outwardly therefrom, the flange having at least one hole formed therethrough;

a plurality of horizontal frame arms fixed to the housing;

a long vertical arm slidably disposed on the frame arms, the long vertical arm being slidable horizontally behind the central shaft and the first and second columns of storage rack units;

a short arm slidably disposed on the long vertical arm, the short arm being slidable vertically on the long vertical arm, the short arm having means for gripping one of said plurality of trays, wherein the means for gripping comprises a pair of vertically adjustable upper and lower jaws, each said jaw having at least one raised bead formed thereon such that the pair of adjustable jaws may selectively clamp the flange of the tray by vertical movement thereof, each of the at least one raised bead of each jaw releasably engaging a corresponding one of the at least one hole formed through the flange;

means for translating the vertical arm horizontally;

means for translating the short arm vertically; and an electronic control panel disposed on the housing, the control panel having:

means for generating a first signal activating the short arm to grip one of said plurality of trays loaded with the shoes at the portal, activating the vertical arm and the short arm to align the gripped tray with an empty rack unit in the columns of storage rack units, and activating the short arm to release the tray in the empty rack unit in order to store the shoes;

means for generating a second signal activating the vertical arm and the short arm to align the short arm with a selected storage rack unit, activating the short arm to grip said one of said plurality of trays loaded with shoes in the selected storage rack unit, activating the vertical arm and the short arm to align the gripped tray with the portal, and activating the short arm to release the tray at the portal in order to retrieve the stored shoes; and means for providing a person storing the shoes with the location of the storage rack unit where the shoes are stored.

2. The system for storing and retrieving shoes according to claim 1, wherein the means for providing the location of the storage rack unit comprises a programmable logic control unit capable of recording the locations of stored shoes and unoccupied storage locations.

3. The system for storing and retrieving shoes according to claim 1, wherein the control unit comprises an input device and an output device.

4. The system for storing and retrieving shoes according to claim 3, wherein the output device has means for providing information related to the location of shoes and the input device has means for receiving information in the same format as the information provided by the output device.

5. The system for storing and retrieving shoes according to claim 4, wherein the input device is selected from the group consisting of a barcode reader, a magnetic strip reader, a radio frequency identification device reader, a keypad, and a touch screen.

6. The system for storing and retrieving shoes according to claim 1, wherein the means for translating the vertical arm horizontally and the means for translating the short arm vertically are selected from the group consisting of a screw drive, a pulley and cable drive, and a belt and sheave drive.

7. The system for storing and retrieving shoes according to claim 1, further comprising an ultraviolet lamp inside the housing to disinfect stored shoes and purify air in the housing.

* * * * *